US010865034B2

(12) United States Patent
Beasley

(10) Patent No.: US 10,865,034 B2
(45) Date of Patent: Dec. 15, 2020

(54) CONTAINER ASSEMBLY WITH DISPENSER

(71) Applicant: Daniel Beasley, Mansfield, OH (US)

(72) Inventor: Daniel Beasley, Mansfield, OH (US)

( * ) Notice: Subject to any disclaimer, the term of this patent is extended or adjusted under 35 U.S.C. 154(b) by 0 days.

(21) Appl. No.: 16/555,243

(22) Filed: Aug. 29, 2019

(65) Prior Publication Data

US 2020/0071058 A1 Mar. 5, 2020

Related U.S. Application Data

(60) Provisional application No. 62/724,151, filed on Aug. 29, 2018.

(51) Int. Cl.
*B65D 83/00* (2006.01)

(52) U.S. Cl.
CPC ..... *B65D 83/005* (2013.01)

(58) Field of Classification Search
CPC ... B65D 83/00; B65D 83/005; B65D 83/0005
USPC ..... 222/342, 386, 405
See application file for complete search history.

(56) References Cited

U.S. PATENT DOCUMENTS 646,135 A * 3/1900 Smith
2,281,251 A * 4/1942 Simmons ..... B65D 83/005 206/527
2,334,595 A * 11/1943 Bailey ..... B65D 83/005 426/389
3,380,592 A * 4/1968 Arnold ..... B65D 83/005 210/244
4,335,609 A * 6/1982 Saulsbury ..... G01F 19/005 222/386
4,627,546 A 12/1986 Carranza
5,082,135 A * 1/1992 DeCoster ..... A47G 19/30 220/694
5,373,971 A * 12/1994 Laffy ..... B05B 11/02 222/189.09
5,626,266 A * 5/1997 Michelson ..... B65D 77/30 222/386
5,634,569 A * 6/1997 DeCoster ..... A47G 19/30 220/735
6,036,038 A * 3/2000 Lovelace ..... B65D 81/22 206/804
6,257,459 B1 * 7/2001 Michelson ..... B65D 83/005 222/322
7,337,705 B1 * 3/2008 Catena ..... A47J 31/20 239/33
7,387,204 B2 * 6/2008 Lee ..... B65D 83/005 206/362

(Continued)

*Primary Examiner* — Paul R Durand
*Assistant Examiner* — Andrew P Bainbridge
(74) *Attorney, Agent, or Firm* — Jacob M. Ward; Ward Law Office LLC

(57) ABSTRACT

A container assembly has a container and a dispenser. The container has a hollow main body. The hollow main body has an open end, an inner surface, and a base wall. The dispenser is movably disposed in the hollow main body. The dispenser has a hollow stem, a handle, and a plunger. The hollow stem has a first end and a second. The first end having a venting aperture. The handle is connected to the first end of the hollow stem. The plunger is connected to the second end of the hollow stem. The plunger has an aperture formed therein. The aperture is in communication with the hollow stem. The plunger further includes an outermost perimeter that conforms to the inner surface of the hollow main body.

19 Claims, 3 Drawing Sheets

(56) References Cited

U.S. PATENT DOCUMENTS

| | | | | |
|---|---|---|---|---|
| 7,487,878 | B2 | 2/2009 | Giwargis et al. | |
| 8,070,007 | B2 * | 12/2011 | Ho | A47J 47/01 220/23.89 |
| 8,079,499 | B2 * | 12/2011 | Juteau | B65D 83/0011 222/390 |
| 9,259,014 | B2 * | 2/2016 | Weiss | A23B 7/158 |
| 9,439,540 | B2 * | 9/2016 | Berry | A47J 43/28 |
| 2005/0133511 | A1 * | 6/2005 | Makriyiannis | B65D 83/005 220/578 |
| 2005/0139091 | A1 | 6/2005 | Haverstock | |
| 2005/0211732 | A1 * | 9/2005 | Cable | B65D 83/0005 222/327 |
| 2010/0005979 | A1 * | 1/2010 | Baccetti | A47J 31/20 100/37 |
| 2015/0014365 | A1 | 1/2015 | Smith et al. | |
| 2020/0071058 | A1 * | 3/2020 | Beasley | B65D 83/005 |

* cited by examiner

CONTAINER ASSEMBLY WITH DISPENSER

CROSS-REFERENCE TO RELATED APPLICATIONS

This application claims the benefit of U.S. Provisional Application No. 62/724,151, filed on Aug. 29, 2018. The entire disclosure of the above application is hereby incorporated herein by reference.

FIELD

The present disclosure relates to containers and, more particularly, to a dispensing device for a container.

BACKGROUND

The dispensing of products from containers, especially the removal of foods that are thick or viscous from cans or jars, can be difficult. This problem is exacerbated as the product gets removed, and the only remaining product is on the bottom and walls of the container which is harder to reach.

One possible solution is to use a spoon or a knife to extend a user's reach to scrape the remaining product off the bottom and walls of the container. However, this is often difficult, if not dangerous. This is especially true if the lid is removed using a can opener. The sharp cut edges of the lid can result in an injury while trying to remove the final amounts of the container's contents.

Another possible solution is to utilize a push-up system. For example, U.S. Pat. No. 8,079,499 to Juteau discloses a jar or bottle container for dispensing food items or other products. The Juteau container has a platform that is supported on a threaded post on the interior of the jar. In a further example, U.S. Patent App. No. 2015/0014365 to Smith et al. teaches a food dispensing jar especially suited for thick or viscous food products.

Undesirably, these push-up systems can be difficult to operate. The act of "pushing" up the dispensing portion can be time consuming and difficult.

There is a continuing need for a dispensing device for a container that allows a user to easily and rapidly remove the contents from the container. Desirably, the dispensing device does not require separate tools for the removal of the contents.

SUMMARY

In concordance with the instant disclosure, a dispensing device for a container that allows a user to easily and rapidly remove contents from the container without using a separate tool has been surprisingly discovered.

In one embodiment, a container assembly has a container and a dispenser. The container includes a hollow main body. The hollow main body has an open end, an inner surface, and a base wall. The dispenser is movably disposed in the hollow main body. The dispenser includes a hollow stem, a handle, and a plunger. The hollow stem has a first end and a second. The first end includes a venting aperture. The handle is connected to the first end of the hollow stem. The plunger is connected to the second end of the hollow stem. The plunger has an aperture formed therein. The aperture is in communication with the hollow stem. The plunger further includes an outermost perimeter. The outermost perimeter conforms to the inner surface of the hollow main body.

In another embodiment, a container assembly has a container and a dispenser. The container includes a hollow main body. The hollow main body has an open end, an inner surface, a base wall, and a lid. The lid is selectively disposed on the open end of the container. The dispenser is movably disposed in the hollow main body. The dispenser has a hollow stem, a handle, and a plunger. The hollow stem includes a first end and a second end. The first end has a venting aperture formed therein. The handle, which is a flexible pull tab, includes an annular body. The handle is coupled to the first end of the hollow stem with a living hinge. The plunger is connected to the second end of the hollow stem. The plunger has an aperture and an outermost perimeter. The aperture is formed in the plunger. The aperture is in communication with the hollow stem. The outermost perimeter conforms to the inner surface of the hollow main body. A first volume of the container is disposed between and defined by the open end, first portion of the inner surface of the hollow main body, and the plunger of the dispenser. A second volume of the container is disposed between and defined by the plunger of the dispenser, a second portion of the inner surface, and the base wall of the hollow main body. The hollow stem and the aperture are configured to permit airflow to the second volume of the container from the atmosphere surrounding the container, as the dispenser moves through the hollow main body of the container. The handle contacts and is pressed into a downward position by an interior surface of the lid where the lid is disposed on the open end of the container. The handle is oriented in an upward position where the lid is removed from the open end of the container.

In a further embodiment, a container assembly has a container and a dispenser. The container includes a hollow main body. The hollow main body has an open end, an inner surface, and a base wall. The dispenser is movably disposed in the hollow main body. The dispenser includes a hollow stem, a handle, and a plunger. The hollow stem has a first end and a second end. The first end includes a venting aperture formed therein. The handle is integral with a lid. The lid is selectively disposed on the open end of the container. The lid has an interior surface and an outer surface. The interior surface is connected to the first end of the hollow stem. The outer surface has an external pull tab disposed thereon. The plunger is connected to the second end of the hollow stem. The plunger has an aperture and an outermost perimeter. The aperture is formed in the plunger. The aperture is in communication with the hollow stem. The outermost perimeter conforms to the inner surface of the hollow main body. A first volume of the container is disposed between and defined by the open end, first portion of the inner surface of the hollow main body, and the plunger of the dispenser. A second volume of the container is disposed between and defined by the plunger of the dispenser, a second portion of the inner surface, and the base wall of the hollow main body. The hollow stem and the aperture are configured to permit airflow to the second volume of the container from the atmosphere surrounding the container, as the dispenser moves through the hollow main body of the container. The lid also has a receiver with an opening. The open is disposed on an interior surface of the lid. The opening receives the first end of the hollow stem. The receiver has an inner diameter and the hollow stem has an outer dimeter. The inner dimeter of the receiver is greater than the outer dimeter of the hollow stem, thereby allowing the hollow stem to be received by the receiver. Also, the receiver has a plurality of fingers. The plurality of fingers extend downwardly from the interior surface of the lid. Each of the plurality of fingers have an inwardly orientated flange with a beveled surface. The beveled surface of each of the inwardly orientated flanges is configured to receive the first end of the hollow stem and militate against the first end from being removed from the receiver. The plurality of fingers are spaced apart and define a plurality of slots. The plurality of slots are configured to permit airflow into the venting aperture of the hollow stem. The first end of the hollow stem further includes a frustoconical head.

In an exemplary embodiment, a container assembly is configured to remove contents from a container. The container assembly includes a hollow main body and a removable dispensing device or "insert" that is disposed within the main body. The container assembly may also have a lid that is selectively secured to a rim of the main body.

The hollow main body is a container of any suitable type known in the art. As non-limiting examples, the hollow main body may be one of a can and ajar. However, other suitable types of containers may also be selected for the hollow main body within the scope of the present disclosure.

In one example, the dispensing device has a base portion that is surrounded by an edge. The edge may form a substantially fluid tight seal with an interior surface of the main body. An aperture is formed in the base portion may be integrally connected to a hollow stem. The hollow stem may be disposed along the length of the main body.

In particular examples, a flexible tab may be attached to the top of the hollow stem to facilitate a grip of the dispensing device. The flexible tab is configured to press against an underside of the lid where the lid is in a closed position that seals an opening of the container main body. The flexible tab is adapted to spring upwardly and above the rim of the main body where the lid is removed to the opened position.

During assembly, the dispensing device is placed inside of the main body prior to filling the main body with contents. The contents desired to be stored are then packaged over the dispensing device. The amount of contents packed in the main body is enough to maximize the volume of the main body, while not covering an opening formed in a top of the hollow stem.

It should be appreciated that the hollow stem has an approximate length selected to be less than that of the main body, but so that the opening of the hollow stem is disposed adjacent to the lid where disposed in the closed position. This relative difference in length militates against contents in the container assembly from clogging a passageway within the hollow stem. The lid is then secured to the main body in the closed position, which forces the flexible tab downwardly from an upright position to a biased position inside of the main body.

In operation, a user will remove the lid of the container assembly. Where the lid is removed, the flexible tab will spring to the upright position above the contents of the main body. To remove the contents of the container assembly, a user will then pull the flexible tab in a direction away from a bottom of the main body. Pulling the flexible tab also pulls the base portion of the dispensing device, thereby forcing the contents of the container assembly from the main body. The hollow stem allows the pressure to equalize in the cavity that forms behind the base portion as it moves. Where the contents of the main body are emptied, a user may dispose of the container assembly including both the hollow main body and the dispensing device.

In another embodiment, the hollow stem may be formed from two or more interconnecting pieces that together form a single telescopic hollow stem. For example, there may be a bottom hollow stem attached to the base portion adjacent the aperture of the dispensing device, and a top hollow stem attached to the lid. The bottom hollow stem may be configured to connect with the top hollow stem.

For example, the bottom hollow stem may have a smaller diameter than the top hollow stem. The bottom hollow stem may have a first arcuate angled flange surrounding the upper opening, and the top hollow stem may have a second arcuate flange surrounding the bottom opening. The bottom hollow stem is inserted into the top hollow stem. The first and second arcuate flanges are of an orientation and configuration which allow them to be inserted in one direction, but which militate against them being pulled apart in a different direction, thereby telescopically connecting the two hollow stem portions.

It should be appreciated that the top hollow stem and the bottom hollow stem do not have to be of identical lengths. It should further be appreciated that the bottom hollow stem disposed within the top hollow stem allows for a single combination top and bottom stem to apply to container assemblies of different lengths.

In a further embodiment, the bottom hollow stem may have grip-tabs and flanges that are configured to connect with apertures formed in the top hollow stem. However, the top and bottom hollow stems may connect using any mechanism chosen by one skilled in the art.

It should be appreciated that the multipiece hollow stems may in certain examples provide for a more efficient container assembly than the single hollow stem. For example, where manufacturing the container assembly, the base portion and bottom hollow stem are disposed in the main body. The contents are packed over the base portion. The top hollow stem is attached to the lid of the main body. As the lid is affixed to the main body to seal the contents, the top hollow stem is connected to the bottom hollow stem. It should be appreciated that in this embodiment, the flexible tab either is not provide or is disposed on the lid separate from the top hollow stem. Thus, the user is able to remove the contents in the main body by removing the lid and pulling both the lid, and likewise the base portion outward from the bottom of the hollow main body, thereby removing the contents within the main body. For example, in certain embodiments, the lid of the main body is a pull-tab lid that is removably sealed on a can.

The main body, lid, and dispensing device may be manufactured using a variety of method and materials. For example, the main body may be a metal can, and more particularly a two-piece draw can, draw-and-wall-ironing cans (DWI), or Toyo Ultimate Can (TULC); the main body may also be a three-piece soldered or welded can. As a further non-limiting example, the dispensing device and flexible tab may be formed of plastic such as Nylon 66. Additionally, although the main body is shown as being cylindrical, and the base portion as a round or arcuate disk, the container assembly may be any other suitable shape as chosen by a skilled artisan.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described herein.

DETAILED DESCRIPTION

Figure 1:
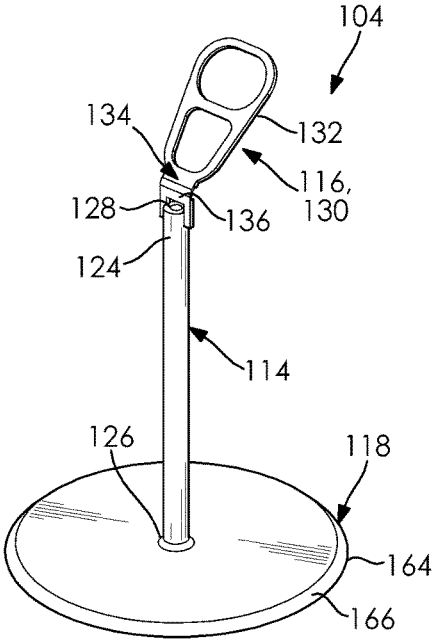
FIG. 1 is a top perspective view of a dispenser for a container according to one embodiment of the present disclosure.
Figure 2:
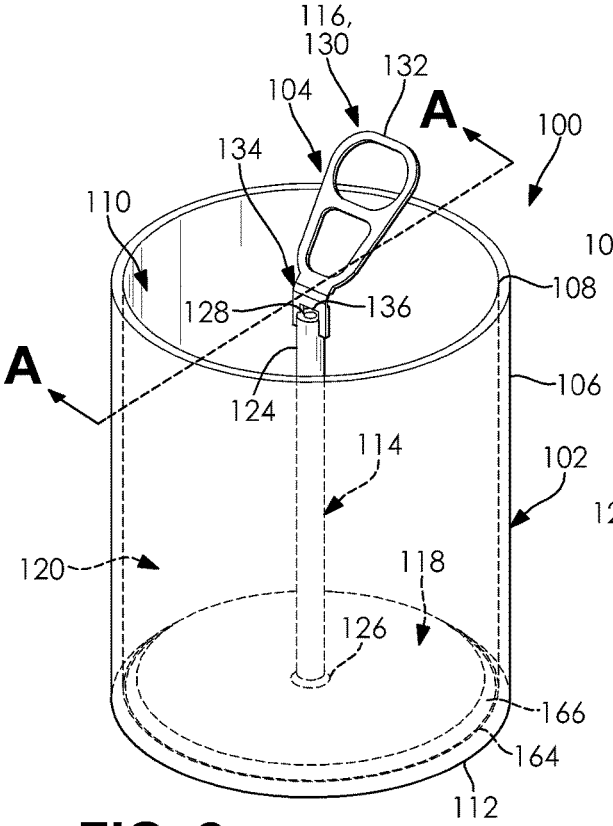
FIG. 2 is a top perspective view of a container assembly including the dispenser shown in FIG. 1 according to one embodiment.

The following detailed description and appended drawings describe and illustrate various embodiments of the invention. The description and drawings serve to enable one skilled in the art to make and use the invention and are not intended to limit the scope of the invention in any manner. In respect of the methods disclosed, the order of the steps presented is exemplary in nature, and thus, is not necessary or critical unless otherwise disclosed.

As shown in FIGS. 2-5 and 7-9, a container assembly 100 has a container 102 and a dispenser 104. The container 102 includes a hollow main body 106. The hollow main body 106 has an open end 108, an inner surface 110, and a base wall 112.

The container 102 may be a standard jar or a storage can. In particular, the container 102 may be a jar or can for storage of food. Non-limiting examples include draw-and-wall ironing cans, stretch-draw-ironing cans, and draw-and-redraw cans. In a most particular example, the container 102 may be about three and two-fifth inches (3.44") by about four and one-half inches (4.56"). In addition, the container 102 may be manufactured using different materials, such as metal or aluminum. Although these dimensions and materials of the container 102 are being supplied for purpose of illustrating the invention, it should be appreciated that a skilled artisan may select other suitable dimensions and materials for the container 102, as desired.

With reference to FIGS. 1-9, the dispenser 104 may include a hollow stem 114, a handle 116, and a plunger 118. The dispenser 104 is movably disposed in the hollow main body 106 of the container 102. In particular, the dispenser 104 is configured to slide within the hollow main body 106 of the container 102 for the purpose of dispensing contents or products from the container 102, as described further herein.

Figure 5:
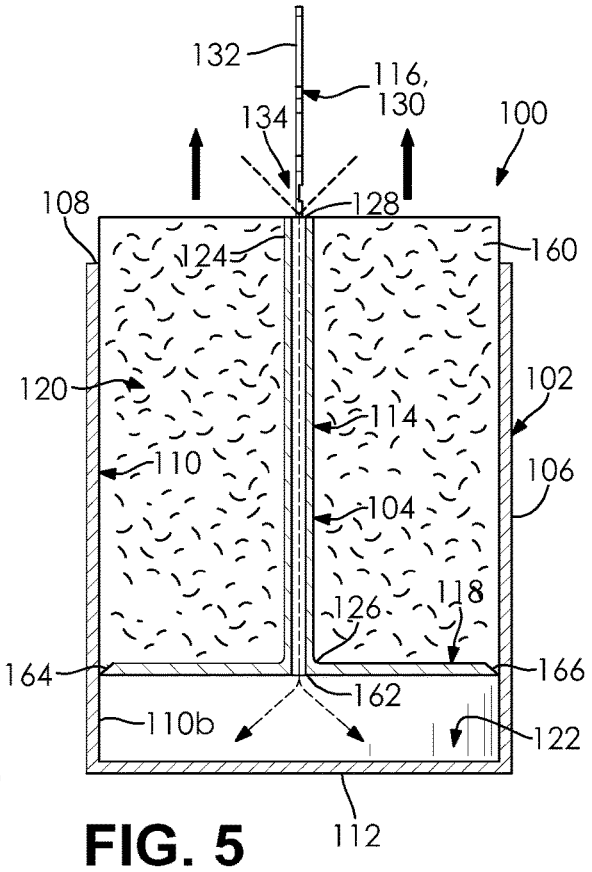
FIG. 5 is a cross-sectional side elevational view taken at section line A-A in FIG. 2, and further showing the flexible pull tab oriented in an upward position, and being pulled, thereby pulling a product from the container.
Figure 6:
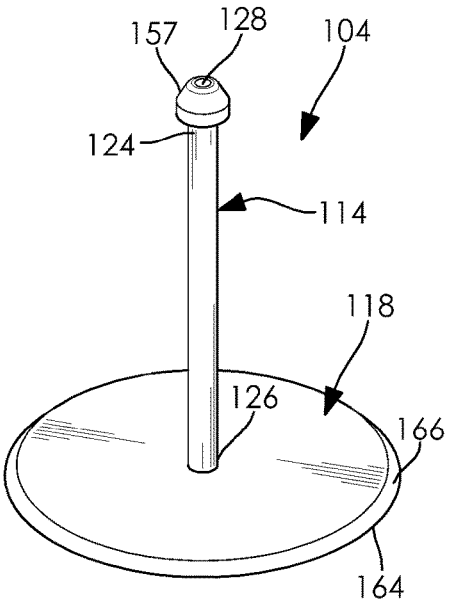
FIG. 6 is a top perspective view of a dispenser according to another embodiment of the present disclosure.
Figure 7:
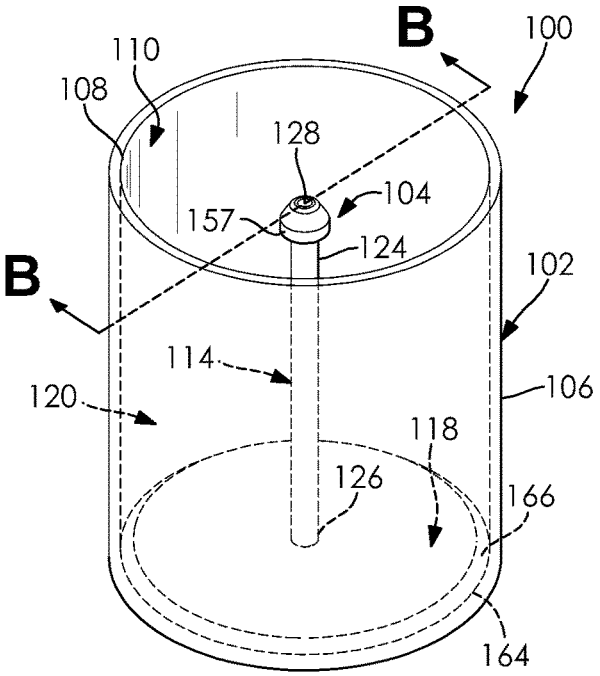
FIG. 7 is a top perspective view of a container assembly, including the dispenser shown in FIG. 6 according to one embodiment.
Figure 9:
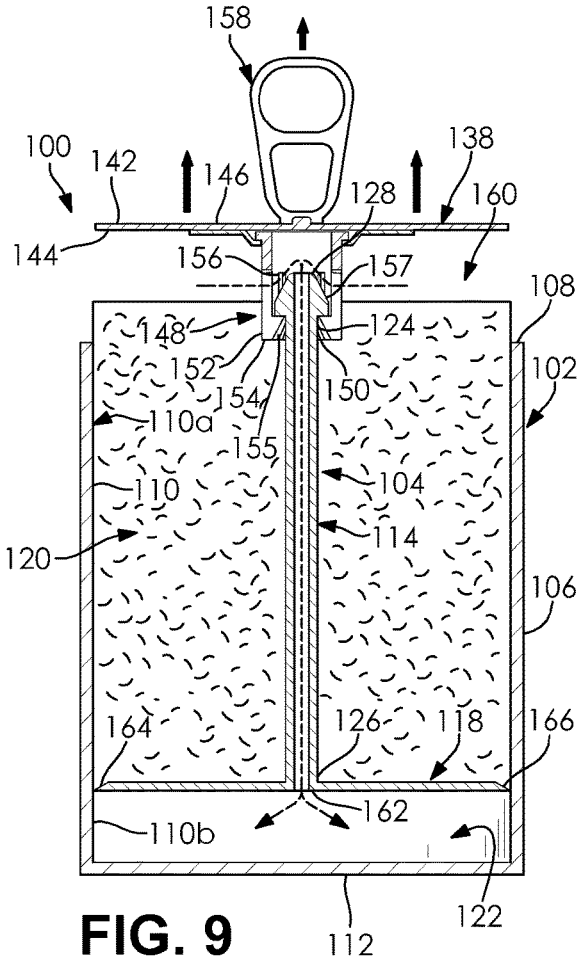
FIG. 9 is a cross-sectional side elevational view taken at section line B-B in FIG. 7, further showing a pull tab disposed on the grip lid, being pulled upward, thereby pulling the product from container.

As shown in FIGS. 5 and 9, it should be further understood that, upon being assembled with the dispenser 104, the container 102 has a first volume 120 and a second volume 122 disposed therein. The first volume 120 is defined by the open end 108 of the container 102, the plunger 118, and a first portion 110*a* of the inner surface 110 of the hollow main body 106 between the open end 108 and the plunger 118. The second volume 122 is defined by the plunger 118, the base wall 112 of the hollow main body 106, and a second portion 110*b* of the inner surface 110 of the hollow main body 106 between the plunger 118 and the base wall 112 of the hollow main body 106.

The dispenser 104 may be manufactured using a variety of methods and materials. For example, the dispensing device may be formed metal, wood, and from food safe materials, such as Nylon 66. Different materials may be selected by a person skilled in the art within the scope of this disclosure.

As shown in FIGS. 2-5 and 7-9, the hollow stem 114 of the dispenser 104 is disposed through the first volume 120 of the container 102. It should be appreciated that the length of the hollow stem 114 is scalable according to the height of the container 102. With reference to FIGS. 1-9, the hollow stem 114 has a first end 124 and a second end 126. The first end 124 of the hollow stem 114 includes a venting aperture 128. In operation, and as discussed in further detail below, the venting aperture 128 is configured to permit airflow between the ambient or surrounding atmosphere and the second volume 122 of the container 102. Desirably, the airflow militates against a vacuum forming in the second volume 122 as the dispenser 104 moves through the container 102.

With continued reference to FIGS. 1-9, the handle 116 of the dispenser 104 is configured to function as a grip for a user. In particular, the handle 116 permits the user to manually pull and move the dispenser 104 through the container 102. In some examples, the handle 116 may be a flexible pull tab 130. The flexible pull tab 130 may have an annular body 132, for example, sized to permit the user to insert a finger through the same. It should be appreciated that a skilled artisan may select different shapes and dimensions of the flexible pull tab 130, as desired.

Referring to FIGS. 1-5, the flexible pull tab 130 may be hingedly coupled to the first end 124 of the hollow stem 114. For example, the flexible pull tab 130 may be coupled to the first end 124 of the hollow stem 114 with a hinge such as a living hinge 134. The living hinge 134 may be flexible but resilient, and through a spring force normally oriented the body of the pull tab 130 into an upward position, even after the body of the pull tab 130 has been depressed or compressed into a downward position, for example, by the application of the lid 142, as described further herein. Suitable materials for the living hinge 134 may include polymers such as thermoplastics. However, one skilled in the art may select other suitable materials for the living hinge 134 within the scope of the disclosure.

In certain embodiments, also shown in FIGS. 1-5, the living hinge 134 may be attached to an arch 136. The arch 136 may be generally inverted U-shaped, for example.

Advantageously, the arch 136 does not cover or block the airflow to the venting aperture 128, thereby permitting the airflow to and from the second volume 122 in operation. It should be appreciated that different methods and types of hinges for attaching the flexible pull tab 130 may be employed by a person skilled in the art, as long as the venting aperture 128 of the hollow stem 114 is not otherwise obstructed.

Figure 3:
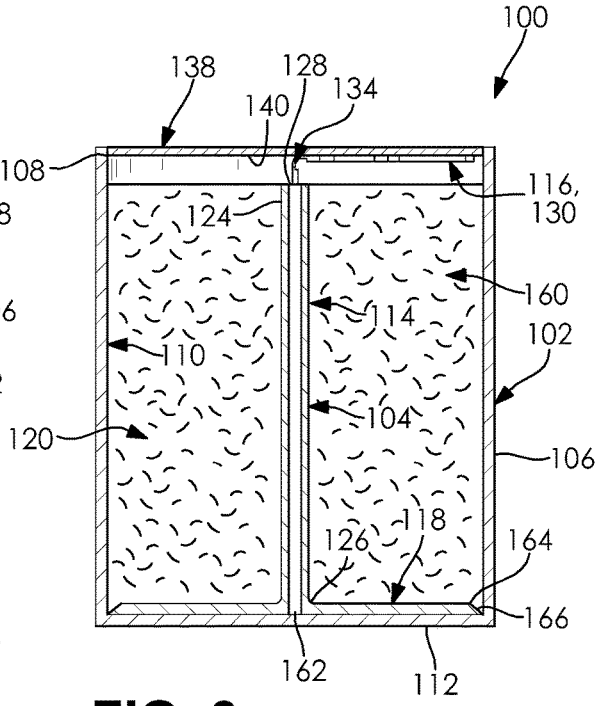
FIG. 3 is a cross-sectional side elevational view taken at section line A-A in FIG. 2, and further showing a lid disposed over an open end of the container and a flexible pull tab oriented in a downward position.
Figure 4:
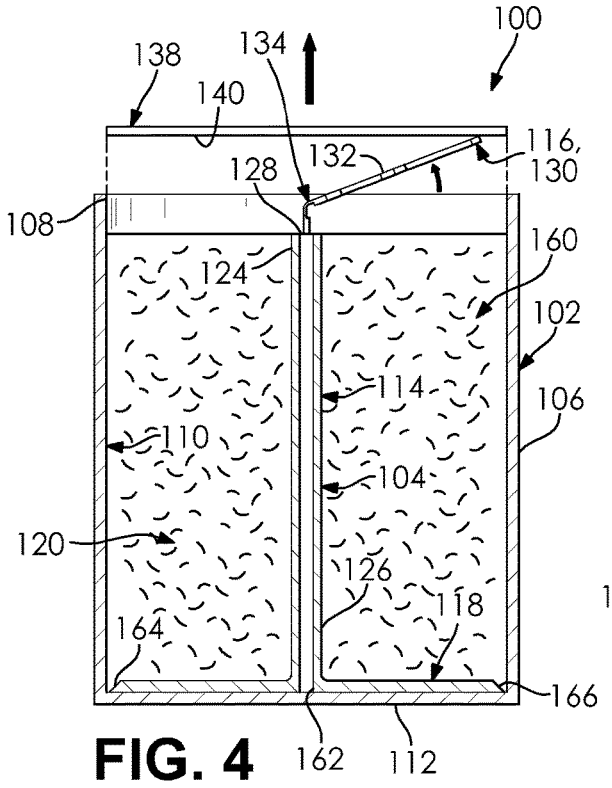
FIG. 4 is a cross-sectional side elevational view taken at section line A-A in FIG. 2, and further showing the lid being removed from the container, and the flexible pull tab orientating into an upward position.

As shown in FIGS. 3-4, the container assembly 100 may further comprise a lid 138. The lid 138 is selectively disposed on the open end 108 of the container 102. Where the lid 138 is in a closed position, the flexible pull tab 130 is pressed downwardly by the lid 138 and orientated parallel with and adjacent to an interior surface 140 of the lid 138, as shown in FIG. 3. Desirably, the downwardly orientation of the flexible pull tab 130 permits the lid 138 to be sealed to the container 102. Where the lid 138 is removed the container 102, the flexible tab 130 becomes undepressed or uncompressed and orientates into an upward position, as shown in FIG. 4. Conveniently, the upwardly orientation or position of the flexible pull tab 130 permits the user to easily grip the flexible pull tab 130.

Now referencing FIGS. 6-10, an alternate embodiment is shown where the handle 116 is integral with the lid 138. In particular, the combined handle 116 and lid 138 may be considered a grip lid 142. The grip lid 142 is selectively disposed on the open end 108 of the container 102. The grip lid 142 has an inner surface 144 and an outer surface 146. The inner surface 144 includes a receiver 148 with an opening 150 formed therein. The opening 150 receives the first end 124 of the hollow stem 114.

In some examples, the opening 150 has a greater diameter than an outer diameter of the hollow stem 114. Desirably, this allows the hollow stem 114 to be received by the receiver 148. It should be appreciated that the length of the receiver 148 is scalable in order to accommodate different containers 102.

Figure 8:
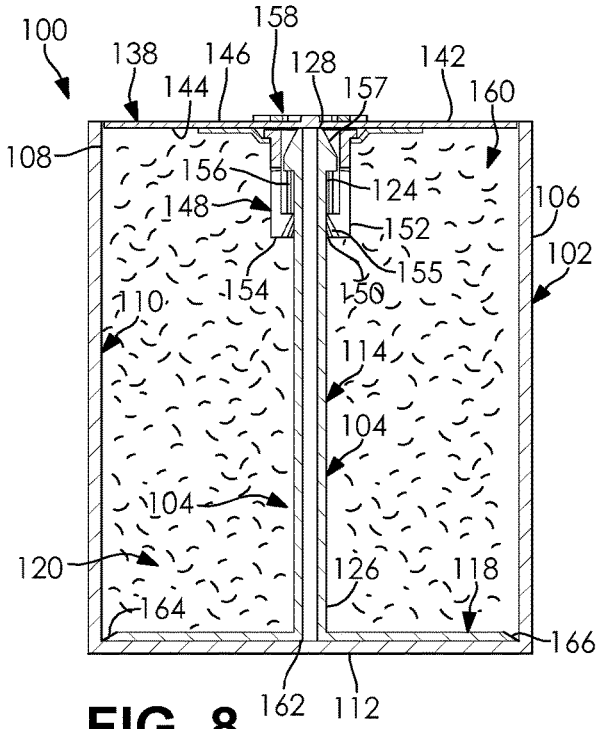
FIG. 8 is a cross-sectional side elevational view taken at section line B-B in FIG. 7, further showing a handle is integral with the lid, and the lid affixed to the open end of the container.
Figure 10:
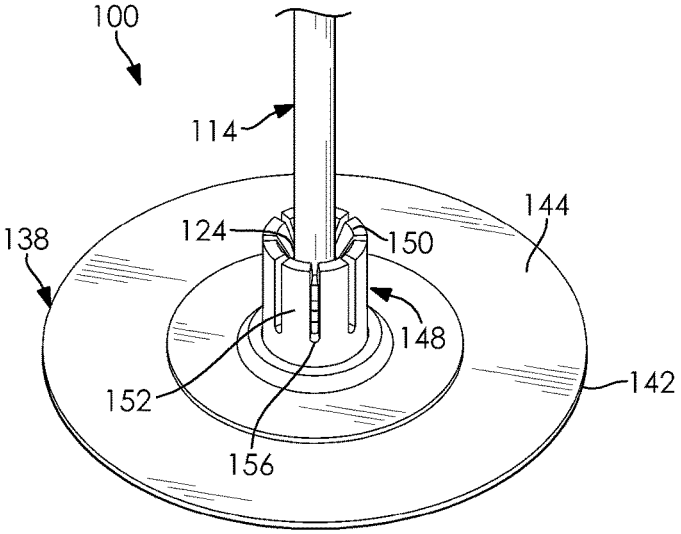
FIG. 10 is a bottom perspective view of the lid with a receiver, and the receiver receiving a first end of a hollow stem.

In particular examples, and as shown in FIGS. 8-10, the receiver 148 may have a plurality of fingers 152 extending downwardly. Each of the plurality of fingers 152 has an inwardly orientated flange 154 with a beveled surface 155. Each of the plurality of fingers 152 are configured to fasten over and grip the first end 124 of the hollow stem 114. Advantageously, the beveled surface 155 of each of the inwardly orientated flanges 154 are configured to easily permit the first end 124 of the hollow stem 114 to be inserted adjacent the fingers 152. In addition, the inwardly orientated flanges 154 are further configured to militate against the first end 124 of the hollow stem 114 from being removed from the receiver 148 after being inserted adjacent the finger 152.

While still referencing FIGS. 8-10, each of the plurality of fingers 152 are spaced apart and define a plurality of slots 156. It is believed that the plurality of slots 156 increases the flexibility of the plurality of fingers 152. Desirably, the increased flexibility of the plurality of fingers 152 allows for the plurality of fingers 152 to more easily fasten over the first end 124 of the hollow stem 114. In addition, the plurality of slots 156 allows the airflow into the venting aperture 128 during an operation of the dispenser 104. It should be appreciated that a person skilled in the art may provide different configurations of the plurality of fingers 152 within the scope of this disclosure.

While now referencing FIGS. 6-10, the first end 124 of the hollow stem 114 may further includes a frustoconical head 157. It is believed that the angled outer surfaces of the frustoconical head 157, in combination with the beveled surfaces 155 of the inwardly oriented flanges 154, permit for the first end 124 of the hollow stem 114 to be more easily inserted into the receiver 148. A skilled artisan may select suitable angles for the outer surfaces of the frustoconical head 157, as desired.

In a further alterative embodiment (not shown), the receiver 148 has a plurality of apertures formed therein, and the first end 124 of hollow stem 114 has a plurality of flexible grip tabs formed thereon and extending outwardly from the outer surface of the hollow stem 114. The plurality of apertures may be sized and shaped so as to receive the flexible grip tabs. In particular, the plurality of apertures receives the plurality of flexible grip tabs where the hollow stem 124 is inserted into the receiver 148. Desirably, an interlocking of the plurality of apertures with the plurality of flexible grip tabs militates against the first end 124 of the hollow stem 114 being removed from the receiver 148.

With reference to FIGS. 8-9, the grip lid 142 may further comprise an external pull tab 158 that is disposed on the outer surface 146 of the grip lid 142. Conveniently, the external pull tab 158 permits a user to easily pull the dispenser 104 from the container 102 via a gripping of the external pull tab 158. The external pull tab 158 may be hingedly attached to an outer surface of the grip lid 142, for example and movable between a downward position where the pull tab 158 lies flat against the outer surface, and an upward position where the pull tab 158 may be gripped by the user. It should be understood a skilled artisan may select different methods of gripping and pulling on the grip lid 142, as desired.

It is believed that the grip lid 142 and the receiver 148 may facilitate, in combination, a manufacturing of the container assembly 100. For example, during the manufacturing process, the dispenser 104 is disposed in the container 102 before the grip lid 142. Then, the grip lid 142 is affixed to the container 102. As the grip lid 142 is being affixed, the receiver 148 receives the first end 124 of the hollow stem 114. Conveniently, this leads to a faster and more efficient manufacturing process. It should be appreciated that a person skilled in the art may also manufacture the container assembly 100 using different methods and steps within the scope of this disclosure.

The plunger 118 is configured to pull a product 160 from the container 102. Nonlimiting examples of the product 160 include food such as cheese or jelly, or nonedible products such as paints. It should be appreciated that a skilled artisan may also select other suitable products 160 to be stored in the container 102, as desired.

As shown in FIGS. 1-9, the plunger 118 is connected to the second end 126 of the hollow stem 114. The plunger 118 has an aperture 162 and an outermost perimeter 164. The aperture 162 is formed therethrough the plunger 118. The aperture 162 is in communication with the hollow stem 114. The aperture 162 provides a path for the airflow to the second volume 122 of the container 102. Desirably, and as previously mentioned herein, providing the path for the airflow serves to equalize the pressure between the second volume 122 of the container 102 and the ambient atmosphere around the container 102 as the dispenser 104 moves therethrough.

With reference to FIGS. 2-5 and 7-9, the outermost perimeter 164 of the plunger 118 conforms to the inner surface 110 of the hollow main body 106. In particular, the outermost perimeter 164 abuts the inner surface 110 while still allowing the plunger 118 to be slidably moved through the container 102. Advantageously, this allows the plunger 118 to effectively pull the product 160 from the container 102 via the outermost perimeter 164 abutting the inner surface 110 and scraping the product 160 off of the inner surface 110. It should be appreciated that, since the plunger 118 conforms to the inner surface 110 of the hollow main body 106, the shape and size of the plunger 118 can be changed to accommodate different types of containers 102.

In some optional embodiments, and as shown in FIGS. 3-5 and 8-9, the outermost perimeter 164 also has beveled edges 166. It is believed that the beveled edges 166 may be more effective at scraping the product 160 off of the inner surface 110 of the hollow main body 106 where the dispenser 104 is being pulled out of the container 102. In further examples, the beveled edges 166 may have a polymer coating, such as a rubberized coating, to provide an effective seal between the beveled edges 166 and the inner surface 110 of the container 102. Other suitable shapes and coatings for the outermost perimeter 164 may also be employed, as desired.

In the assembling process, the dispenser 104 is placed into the hollow main body 106 of the container 102. The hollow stem 114, the venting aperture 128, and the aperture 162 of the plunger 118 are configured to permit the airflow between the ambient atmosphere around the container 102 and the second volume 122 of the container 102. Desirably, permitting the airflow to the second volume 122 militates against a vacuum from forming in the second volume 122, when the dispenser 104 is initially disposed in the hollow main body 106 of the container 102. The forming of the vacuum would otherwise undesirably militate against the plunger 118 from being pulled away from the base wall 112 of the container 102. Likewise, it is believed that the permitted airflow to and from the second volume 122 of the container 102 allows the plunger 118 to be fully inserted during the initial assembly, and abut the base wall 112 of the container 102, while closely confirming with the inner surfaces of the container 102. This would otherwise be difficult to do if the air were to be trapped between the plunger 118 and the base wall 112.

After the dispenser 102 is disposed in the hollow main body 106 of the container 102, the product 160 is placed into the first volume 120 of the container 102. None of the product 160 is placed in the second volume 122 of the container 102. It should be appreciated that the amount of product 160 placed, poured, or packed into the first volume 120 of the container 102 is enough to fill the first volume 120 but does not obstruct the venting aperture 128 of the hollow stem 114. It should also be appreciated that obstructing the venting aperture 128 may otherwise prevent the airflow to and from the second volume 122 of the container 102 in operation of the dispenser 104.

In order to seal and preserve the products 160, and as shown in FIGS. 3-4 and 8-9, for example, the lid 138 may be selectively affixed to the open end 108 of the container 102. As mentioned previously, where the lid 138 is selectively affixed to the open end 108, the handle 116, such as the flexible pull tab 130, may be depressed or compressed and oriented into the downward position to allow the lid 138 to otherwise seal with the hollow main body 106. It should be further understood, that in alternative embodiments, as shown in FIGS. 8-9, this step is not required as the handle 116 is integral to the lid 138, in the form of the grip lid 142 described hereinabove, which is selectively affixed with the hollow main body 106.

In operation of the embodiment shown in FIGS. 1-5, the first step involves removing the lid 138 from the container 102. For example, the removing of the lid 138 may involve using a standard hand-held can opener. Other methods of removing the lid 138 from the container 102 can be employed, as desired. Once the lid 138 is fully removed, the flexible pull tab 130 becomes now undepressed or uncompressed by the lid 138, and due to a spring force of the hinge 134 orientates from the downward position into an upward position. Conveniently, this upward position is above the product 160, so the user does not have to fish the flexible pull tab 130 from the product 160. Next, the user pulls the flexible pull tab 130 which pulls the product 160 out of the hollow main body 106 of the container 102 via the plunger 118. Desirably, as the plunger 118 moves through the hollow main body 106, the outermost perimeter 164 scrapes or wipes the inner surface 110 of the container 102, thereby dislodging any product 160 on the inner surface 110.

In operation of the alternative embodiment as shown in FIGS. 6-10, the first step involves removing the grip lid 142 from the container 102. For example, the can opener mentioned previously. It should be appreciated that other methods of removing the grip lid 142 can be employed by a person skilled in the art. Next, the user grips the grip lid 142 using the external pull tab 158 and pulls the product 160 via the plunger 118 from of the container 102. Other methods of gripping the grip lid 142 may be used, as desired.

Advantageously, the container assembly 100 via the dispenser 104 allows the user to easily and rapidly remove the contents from the container 102 without using a separate tool such as a spatula or spoon. In addition, permitting the airflow to and from the second volume 122 of the container 102, militates against a vacuum from forming in the second volume 122. Desirably, and as mentioned above, militating against the formation of the vacuum allows for the assembly and operation of the container assembly 100 to be easier and more efficient.

While certain representative embodiments and details have been shown for purposes of illustrating the invention, it will be apparent to those skilled in the art that various changes may be made without departing from the scope of the disclosure, which is further described in the following appended claims.

What is claimed is:

1. A container assembly, comprising:

a container having a hollow main body with an open end, an inner surface, and a base wall; and a dispenser movably disposed in the hollow main body, the dispenser including a hollow stem with a first end and a second end, the first end having a venting aperture formed therein, a handle connected to the first end of the hollow stem, and a plunger connected to the second end of the hollow stem, the plunger having an aperture formed therein, the aperture in communication with the hollow stem, and the plunger further including an outermost perimeter conforming to the inner surface of the hollow main body, wherein the handle is a flexible pull tab coupled to the first end of the hollow stem with a living hinge.

2. The container assembly of claim 1, wherein the outermost perimeter of the plunger has beveled edges, the beveled edges extending towards the base wall of the container.

3. The container assembly of claim 2, wherein the container has a first volume and a second volume, the first volume of the container disposed between and defined by the open end and a first portion of the inner surface of the hollow main body and the plunger of the dispenser, and the second volume of the container disposed between and defined by the plunger of the dispenser and a second portion of the inner surface and the base wall of the hollow main body.

4. The container assembly of claim 3, wherein the hollow stem is disposed through the first volume of the container.

5. The container assembly of claim 4, wherein the first volume is configured to store a product for dispensing and the second volume is not configured to store the product.

6. The container assembly of claim 5, wherein the hollow stem and the aperture are together configured to permit airflow to the second volume of the container from the atmosphere surrounding the container as the dispenser moves through the hollow main body of the container.

7. The container assembly of claim 6, further comprising a lid selectively disposed on the open end of the container.

8. The container assembly of claim 7, wherein the handle of the dispenser is disposed adjacent to an interior surface of the lid where the lid is disposed on the open end of the container.

9. The container assembly of claim 8, wherein the flexible pull tab is oriented in a downward position when the lid is disposed on the open end of the container and the flexible pull tab is oriented in an upward position when the lid is removed from the open end of the container.

10. The container assembly of claim 9, wherein the flexible pull tab contacts and is pressed into the downward position by the interior surface of the lid where the lid is disposed on the open end of the container.

11. The container assembly of claim 7, wherein the handle is integral with the lid.

12. The container assembly of claim 11, wherein the lid further has an external pull tab disposed on an outer surface of the lid.

13. The container assembly of claim 12, wherein the lid further has a receiver with an opening disposed on an interior surface of the lid, the opening receiving the first end of the hollow stem.

14. The container assembly of claim 13, wherein the receiver has an inner diameter and the hollow stem has an outer diameter, the inner diameter of the receiver being greater than the outer diameter of the hollow stem, thereby allowing the hollow stem to be received by the receiver.

15. The container assembly of claim 14, wherein the receiver further has a plurality of fingers extending downwardly from the interior surface of the lid, each of the plurality of fingers having an inwardly orientated flange with a beveled surface, and wherein the beveled surface of each of the inwardly orientated flanges is configured to receive the first end of the hollow stem and militate against the first end from being removed from the receiver.

16. The container assembly of claim 15, wherein the plurality of fingers are spaced apart and define a plurality of slots, the plurality of slots configured to permit airflow into the venting aperture of the hollow stem.

17. The container assembly of claim 16, wherein first end of the hollow stem further includes a frustoconical head.

18. A container assembly, comprising:

a container having a hollow main body with an open end, an inner surface, a base wall, and a lid selectively disposed on the open end of the container;

a dispenser movably disposed in the hollow main body, the dispenser having a hollow stem having a first end and a second end, the first end having a venting aperture formed therein, a handle which is a flexible pull tab having an annular body, the handle coupled to the first end of the hollow stem with a living hinge, a plunger connected to the second end of the hollow stem, the plunger having an aperture formed therein, the aperture in communication with the hollow stem, and the plunger further having an outermost perimeter conforming to the inner surface of the hollow main body; and wherein a first volume of the container is disposed between and defined by the open end and a first portion of the inner surface of the hollow main body and the plunger of the dispenser, and a second volume of the container is disposed between and defined by the plunger of the dispenser and a second portion of the inner surface and the base wall of the hollow main body;

wherein the hollow stem and the aperture are together configured to permit airflow to the second volume of the container from the atmosphere surrounding the container as the dispenser moves through the hollow main body of the container;

wherein the handle contacts and is pressed into a downward position by an interior surface of the lid where the lid is disposed on the open end of the container;

wherein the handle is oriented in an upward position where the lid is removed from the open end of the container; and wherein the handle is a flexible pull tab coupled to the first end of the hollow stem with a living hinge.

19. A container assembly, comprising:

a container having a hollow main body with an open end, an inner surface, and a base wall;

a dispenser movably disposed in the hollow main body, the dispenser having a hollow stem having a first end and a second end, the first end having a venting aperture formed therein, a handle integral with a lid selectively disposed on the open end of the container, the lid having an interior surface and an outer surface, the interior surface connected to the first end of the hollow stem, the outer surface having an external pull tab disposed thereon, a plunger connected to the second end of the hollow stem, the plunger having an aperture formed therein, the aperture in communication with the hollow stem, and the plunger further having an outermost perimeter conforming to the inner surface of the hollow main body;

wherein the outermost perimeter of the plunger has beveled edges, the beveled edges extending towards the base wall of the container;

wherein a first volume of the container is disposed between and defined by the open end and a first portion of the inner surface of the hollow main body and the plunger of the dispenser, and a second volume of the container is disposed between and defined by the plunger of the dispenser and a second portion of the inner surface and the base wall of the hollow main body;

wherein the hollow stem and the aperture are together configured to permit airflow to the second volume of the container from the atmosphere surrounding the container as the dispenser moves through the hollow main body of the container;

wherein the lid further has a receiver with an opening disposed on an interior surface of the lid, the opening receiving the first end of the hollow stem;

wherein the receiver has an inner diameter and the hollow stem has an outer diameter, the inner diameter of the receiver being greater than the outer diameter of the hollow stem, thereby allowing the hollow stem to be received by the receiver;

wherein the receiver further has a plurality of fingers extending downwardly from the interior surface of the lid, each of the plurality of fingers having an inwardly orientated flange with a beveled surface, and wherein the beveled surface of each of the inwardly orientated flanges is configured to receive the first end of the hollow stem and militate against the first end from being removed from the receiver;

wherein the plurality of fingers are spaced apart and define a plurality of slots coextending downwardly with the plurality of fingers, the plurality of slots configured to permit airflow into the venting aperture of the hollow stem; and wherein first end of the hollow stem further includes a frustoconical head.

* * * * *